US006761440B2

(12) United States Patent
Chou et al.

(10) Patent No.: US 6,761,440 B2
(45) Date of Patent: Jul. 13, 2004

(54) INK CARTRIDGE WITH NEGATIVE-PRESSURE REGULATING MECHANISM

(75) Inventors: Chin-Te Chou, Taipei (TW); Chuang-Hsien Chiu, Hsin Chu County (TW)

(73) Assignee: NanoDynamics Inc. (TW)

( * ) Notice: Subject to any disclaimer, the term of this patent is extended or adjusted under 35 U.S.C. 154(b) by 0 days.

(21) Appl. No.: 10/175,404

(22) Filed: Jun. 20, 2002

(65) Prior Publication Data

US 2003/0020789 A1 Jan. 30, 2003

(30) Foreign Application Priority Data

Jul. 24, 2001 (TW) ..... 90118097 A

(51) Int. Cl.[7] ..... B41J 2/045
(52) U.S. Cl. ..... 347/86; 347/86; 347/89
(58) Field of Search ..... 347/84, 85, 86, 347/87, 88

(56) References Cited

U.S. PATENT DOCUMENTS 5,992,992 A * 11/1999 Gibson ..... 347/94

* cited by examiner

*Primary Examiner*—Stephen D. Meier
*Assistant Examiner*—Ly T Tran
(74) *Attorney, Agent, or Firm*—Bacon & Thomas, PLLC

(57) ABSTRACT

An ink cartridge with negative-pressure regulating mechanism, comprising a first ink chamber, a second ink chamber and an regulating mechanism; the regulating mechanism is of a interlocking device composed of a damping device and a valve that, installed between the first ink chamber and the second ink chamber, is used for being the valve connecting the first ink chamber and the second ink chamber; when ink in the second ink chamber is being used, the inner pressure of the second ink chamber is to be lowered, thus activating the regulating mechanism, so that ink in the first ink chamber is led into the second ink chamber for stable replenishment.

1 Claim, 7 Drawing Sheets

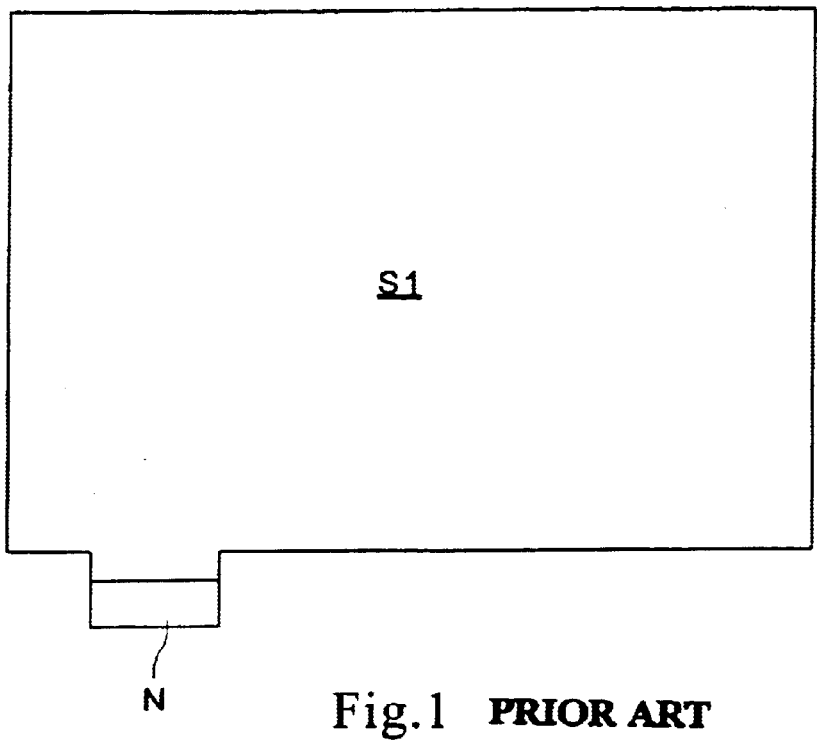
Fig.1 PRIOR ART
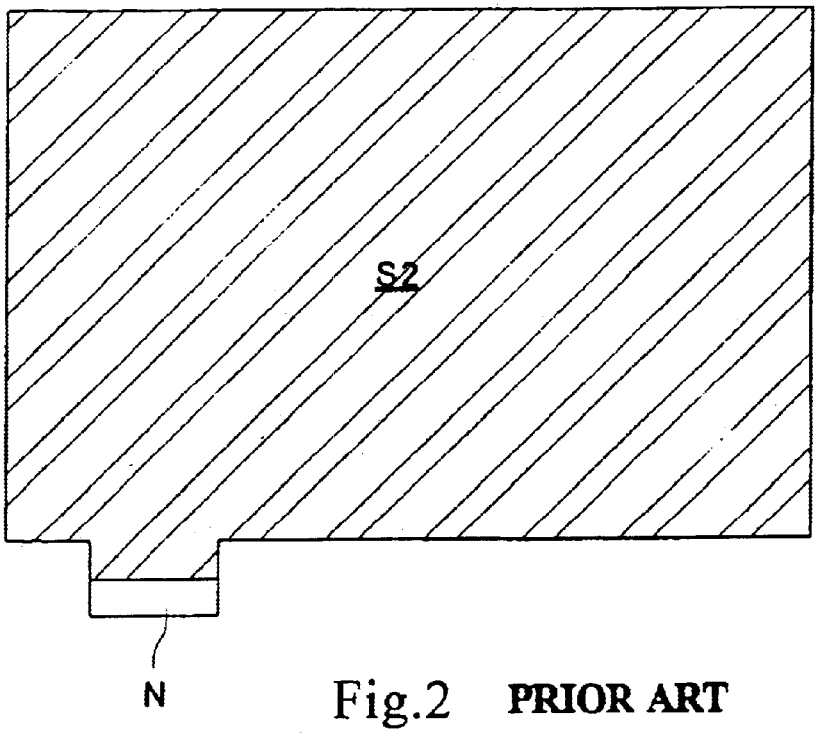
Fig.2 PRIOR ART

INK CARTRIDGE WITH NEGATIVE-PRESSURE REGULATING MECHANISM

BACKGROUND OF THE INVENTION

1. Field of the Invention

The ink cartridge of the invention is installed with the regulating mechanism between the first and second ink chambers, and the regulating mechanism, activated with the variations of the inner pressure, is to connect the first and second ink chambers, enabling the second ink chamber to maintain negative pressure for stable replenishment of ink.

2. Description of the Prior Art

Based upon the history of invention regarding printers, printers on the market can be divided into three categories according to common usage: earlier dot-matrix printers, later ink-jet printers and laser printers. Nowadays ink-jet or laser printers have already constituted the mainstream on the market, with advantages and disadvantages shown for both types of printers. At first, ink-jet printers are less expensive than laser printers; secondly, as far as the printing quality is concerned, laser printers then provide better printing quality than that of ink-jet printers.

Even though ink-jet printers have the price advantage over laser printers, in terms of the printing quality, however, the ink-jet printers would lose the competitive edge against laser printers in applicable fields that require high printing quality. Generally speaking, ink in ink-jet printers diffuses, and because the printing material ink-jet printers use is of fluid, thus certain natural flaws existed in fluid during application seriously compromise the printing quality of ink-jet printers, e.g., the non-rigid body of the fluid, fluid's not flowing smoothly, bubbles existed in fluid and with the low viscosity coefficient of fluid, it is difficult to control the flowing direction.

The most primordial prior art for the ink cartridge of ink-jet printers is to fill ink directly into the ink cartridge; that is to say, there is only ink contained in the containing space of the ink cartridge without any other substances. Later on such technology almost totally exposed the foregoing drawback of the ink-jet printers, that is to say, the drawbacks caused by the uncontrollability of fluid were thoroughly manifested by the primordial ink cartridge technology. Even though later on new designs have been presented to try to improve on the foregoing drawbacks, the problem derived from the uncontrollability of fluid still exists. The invention is thus developed to solve such difficulty so as to the problem can be broken through. The prior arts in this field are to be introduced first:

1. Prior Art (1)

The most primitive prior art of the ink cartridge in ink-jet printers is to fill ink directly into the structural space of ink cartridges, as shown in FIG. 1. What FIG. 1 shows is a simple diagram of the ink cartridge, wherein N represents the ink-jet nozzle, which is a device where ink is spurted, and S1 represents the space of the ink cartridge in which ink is filled, also the space where ink is replenished.

Though such prior art is not original at all, it is simply designed with lower production cost, yet such design fully exposes the drawback of the uncontrollability of fluids. Because the ink-jet nozzle is located underneath, thus an ink-feeding orifice underneath the ink cartridge (where ink is spurted) has to be designed; since the gravitational force leads liquid to flow downwards, ink in the ink cartridge could be led to leak downwards. Thus the only way to prevent such leaking is to depend on the surface tension of liquids. Only when the surface tension of the liquid at the ink-jet nozzle and the hydraulic pressure reach the equilibrium of force might the leaking of ink be prevented.

However, because the surface tension of liquids is not huge enough; therefore, if the surface tension is to be used for sustaining the liquid pressure of ink at the ink-jet nozzle, the vertical depth and diameter of the ink-spurting orifice, the viscosity coefficient and the surface tension of ink, and the weight and height level of the remaining ink are to be calculated and designed, so as to maximize the result of preventing leaking of ink through precise calculation to select all the parameters.

Yet with the surface tension of liquids being too insignificant that the impact thereof in the equation of the equilibrium of force is not significant either comparing to that from other elements, any slight variation of parameters shall compromise the equilibrium of force, thus causing the leaking of ink for printers due to the surface tension of liquid unable to sustain the liquid pressure. Under such circumstances, all elements possible of influencing the equilibrium of force need to be precisely designed and controlled during the uninterrupted use of ink. However, the elements capable of influencing the equilibrium of force are numerous and some of them are difficult to control, e.g., the variation of liquid pressure during uninterrupted use of ink, the impact of temperature, ink components and impurities in solution on the viscosity coefficient and the surface tension, also the impact of the air pressure inside the ink cartridge and the atmospheric pressure, all the elements that are not only difficult to control, but under the circumstances of the foregoing elements' impact force far larger than the surface tension of liquids on the equation of the equilibrium of force, any minute variation of an element is capable of compromising the equilibrium equation. Consequently, such field of precise liquid mechanical control costs too much and is difficult to achieve.

2. Prior Art (2)

Improvements on the prior art (1) achieved include installing water-absorbing material S2 (e.g., sponge) in the structural space of the ink cartridge, as shown in FIG. 2. Such improvement, in terms of the prior art (1), does correct the drawback of ink leaking, but also emerges following such improvement is that ink filled in the ink cartridge cannot be thoroughly used.

As shown in FIG. 2, when the ink cartridge is filled with sponge that has powerful water-absorbing ability, ink can be tightly absorbed in the ink cartridge, thus preventing ink from leaking or drooping, and alleviating the burden borne by the surface tension. Therefore, in the equation of the equilibrium of force, the absorbing ability of sponge in the ink cartridge is also to be counted, along with the surface tension of ink, as part of the force to prevent ink from leaking, and through calculation, the degree of the absorbing ability of sponge is larger than that of the surface tension of ink. Thus, the improvement of the Prior art (2) enables the equilibrium of force not to be easily undermined by factors in the prior art (1) that are capable of affecting the equilibrium and hard to control. Under the circumstance, the absorbing force provided by sponge keeps ink in the ink cartridge from leaking easily, and thus ridding of the drawback of ink leaking of the printer, a design that is the most important feature of such technology.

Nevertheless, since the containing space of the ink cartridge is limited, when sponge is filled therein, the quantity of ink that can be filled in is to be decreased. Furthermore, because the water-absorbing material, like sponge, has the absorbing force, when ink is about to be used up, a certain portion of ink that is unable to overcome the absorbing force of sponge, is to be kept in the ink cartridge, thus causing such portion of ink to be wasted. For example, a space in the ink cartridge that is originally designed to fill in 40 g of ink is to be partially occupied with sponge, thus only 30 g of ink can be filled in, whereas for such 30 g of ink, about 6 g to 7 g of ink is to be absorbed by sponge and remained in the ink cartridge without being able to be used. As a result, by design 40 g of ink is supposed to be available for use, yet the user can only use about 23 g to 24 g of ink eventually, a drawback that is a waste in terms of the use of both space and ink.

Moreover, another serious flaw of such technology is the unsmooth flow of ink. Because sponge possesses both characters of the water-absorbing ability and the incompact organic structure, not only ink but also air can be absorbed. Therefore, during the feeding of ink from the ink cartridge, air bubbles large or small are to remain in the ink cartridge; if such air bubbles are not to be smoothly discharged, then during the printing process, those bubbles remained in the ink cartridge are to cause unsmooth flow of ink, thus leading to the interruption of printing or different gradation of printing colors, with the printing quality being significantly deteriorated.

Finally, to place sponge into the ink cartridge has to do with the sponge material and characteristics of ink, thus the production process is to be complicated, the manufacturing quality not easy to control, the manufacturing technology difficult, and the production cost significantly increased.

Such technology does improve upon the drawback of the ink leaking; however, because of the serious drawbacks that the space of the ink cartridge and ink filled therein cannot be thoroughly utilized, as well as the deteriorated printing quality and complicated manufacturing process, such technology is unable to be treated as a fine and practical design.

3. Prior Art (3)

Even though the prior art (1) is able to thoroughly utilize the space in the ink cartridge and ink filled therein, there exists the drawback of ink leaking; even though prior art (2) does not have such drawback of ink-leaking, it is unable to thoroughly utilize the space in the ink cartridge and ink filled therein. Therefore, the prior art (3) is to improve upon the drawbacks of the prior art (1) and (2) by combining such two prior arts, thus acquiring a balanced design between the two prior arts.

As shown in FIG. 3, the prior art (3) divides the space of the ink cartridge into S31 and S32, wherein S31 uses the design of the prior art (1), and S32 the design of the prior art (3); which is to say, the space of S31 is used only for containing ink, whereas the space of S32 is to be placed with water-absorbing material like sponge, along with ink.

The design for S31 that, used only for containing ink without placing sponge in, is to take advantage of the merit of the prior art (1) and get rid of the drawback of the prior art (2); S31 is not directly connected to the ink-jet head N in terms of the structural position, a design that also avoids the drawback of the prior art (1) by taking advantage of the merit of the prior art (2). In other words, since S31 is not placed with sponge therein, the merit of thoroughly utilizing the space and ink filled in. In addition, since S31 is not directly connected to the ink-jet head N in terms of the structural position, the drawback of ink leaking is to be avoided.

As for S32, wherein both ink and sponge are filled in, it is to connect with the ink-jet head N in terms of the structural position, which is to take advantage of the merit of the prior art (2) and get rid of the drawback of the prior art (1). In other words, the ink-leaking problem can be avoided through sponge placed in the ink cartridge and the connection with the ink-jet head N by S32 in terms of the structural position.

The prior art (3) combines the merits from both the prior art (1) and (2) through acquiring a balanced design between the two prior arts; however, limitations are to exist against such balanced design. First of all, to avoid ink-leaking, the quantity of sponge to be placed in the ink cartridge might vary, yet certain quantity of sponge has to be placed therein; thus as long as certain quantity of sponge exists in the ink cartridge, the drawbacks in the prior art (2) of the inability to thoroughly utilize the space of the ink cartridge and ink filled in are to exist at the same time. Furthermore, to avoid ink-leaking, the placing area for sponge in the ink cartridge has to be connected with the ink-jet head N, and it is exactly such design that air bubbles in sponge are to cause the unsmooth flow of ink during the printing process by having thin white stripes, thus unable to totally get rid of the problem of the printing quality deterioration.

Aside from the foregoing drawbacks in the three prior arts elaborated above, there is a common drawback for all three prior arts. During the process of using up ink in the ink cartridge, the water level of ink in the ink cartridge is to be consequently lowered with the usage of ink, thus the upper part of the ink cartridge inside is to be emptied by degrees. If such space is to be maintained as a control mass system, then under the circumstance that air (gas) is not to be replenished, according to the preferred air equation:

$PV=nRT$, wherein

P: Pressure

V: Volume n: number of moles in gas

T: Temperature

During which n, R and T are remained constant; during the process of using ink, V is to become larger; thus, according to the foregoing equation, P is to be smaller by degrees.

It is to be concluded, based upon the foregoing extrapolation, during the process of ink being used up, the atmospheric pressure at the upper space in the ink cartridge is to become smaller; in other words, under the original circumstance that the atmospheric pressure of such space is already smaller than one atmospheric pressure (negative atmospheric pressure), since the atmospheric pressure of such space is getting smaller, the pressure difference between such space and the exterior (one atmospheric pressure) is to be larger and larger. In the equation of equilibrium of force, such pressure difference (the atmospheric pressure in the exterior is larger than the that in the exterior) is to prevent ink from flowing out downwards; in other words, the larger the pressure difference, the larger the suction to ink, thus causing the flowing-out of ink more difficult.

Because ink-jet printers has the drawback of ink-leaking, the condition that the suction to ink caused by the pressure difference between the exterior and the interior of such space in the ink cartridge can be utilized to prevent ink from leaking. Yet if no gas is provided in the upper space of the ink cartridge (that is, to maintain the control mass), then, with the pressure difference between such space and the exterior becoming larger, the suction caused therefrom is to prevent ink from flowing out at all, thus rendering the ink cartridge unable to be used.

Therefore, the replenishment of gas into the upper space of the ink cartridge is necessary. Yet, for the purpose of preventing the atmospheric pressure in the upper space of the ink cartridge from being identical to that in the exterior, as well as keeping the negative pressure in the interior of the ink cartridge, resistance force to the entry of outside gas into such space must be set up, and such resistance force is exactly identical to the pressure difference between those in such space and the exterior. For example, in the prior art (3), a small hole H31, installed on top of the ink cartridge space S32, is used for the outside gas to enter into S32; with the outside gas passing H32 and S31 and reach S33 to increase the pressure thereof. At this time sponge and ink in S32 as well as ink in S31 are all acted as resistance force for maintaining the pressure difference between those in both the interior and the exterior desired by the designer.

However, for keeping the resistance force to maintain the pressure difference between the interior and the exterior desired by the designer, the speed of introduction in terms of the outside gas from the exterior cannot be too hasty. Yet with such limitation, when the workload of printers increases, ink is to be used in large quantity under a short period of time. At this time, the water level of ink in the ink cartridge is to be speedily lowered. Under such circumstance, the space in the interior of the ink cartridge is to be increased, and under the premise that pressure and volume being in reversed ratio, the internal pressure lowers speedily at the same time. At this time, for the air on the outside meets the resistance while entering into the ink cartridge, causing air on the outside unable to compensate in time for the pressure decreased, the pressure difference is to be huge enough to stop ink from flowing out or to cause unsmooth flow of ink, thus resulting in interruption or insufficient density of ink during the printing process, eventually deteriorating the printing quality.

Based upon the elaboration above, The existing prior arts present problems like ink-leaking, unable to thoroughly utilize the space in the ink cartridge, and ink filled therein, or unsmooth flow of ink resulting in interruption of the printing process and deterioration of the printing quality. Moreover, even though resistance against gas that enters into the ink cartridge is set up to effectively maintain the pressure difference, the speed of replenishment of gas outside is to be lowered at the same time, thus causing tremendous use of ink and the swift increase of the pressure difference during printing in large quantity. At this time gas replenished slowly cannot immediately compensate for the internal pressure, thus causing ink to be difficult to flow out and deteriorate the printing quality. All those drawbacks existed in prior arts desperately need to be improved upon. Thus the invention is disclosed for improving upon those drawbacks in prior arts, thus the printing quality of ink-jet printers can be upgraded, so as to be able to compete with laser printers; also, with the lower prices of ink-jet printers, the market competitiveness thereof can be comparatively expanded.

SUMMARY OF THE INVENTION

The primary object of the invention is to provide an ink cartridge having negative-pressure regulating mechanism regulating mechanism, with the working of the regulating mechanism regulating mechanism, the negative pressure in the ink cartridge can be regulated, so that a stable negative pressure can be maintained in the ink cartridge; consequently improving upon the drawbacks of unsmooth flow of ink due to too much negative pressure, and ink-leaking caused by only slight vibration.

The ink cartridge having negative-pressure regulating mechanism of the invention comprises the first ink chamber, the second ink chamber and the regulating mechanism; said second ink chamber is formed with an air passage through which outside air can be reached, and an ink outlet, used for being the outlet of ink-jetting. Said regulating mechanism, installed at said air passage of said second ink chamber, with the other end connected to the atmosphere, is used for being a valve between the first and second ink chambers. Such regulating mechanism is of an interlocking device composed of a piston and a damping device, and the piston is caused to slide toward the inner side of the second ink chamber by the lowering of the inner pressure during the ink-feeding process from the second ink chamber, with an ink passage installed on the piston between the first and second ink chambers, thus when the piston slides inward, the first and second ink chambers are connected by the ink passage of the piston, and ink in the first ink chamber can flow to the second ink chamber through the ink passage.

The pressure in the second ink chamber of the ink cartridge of the invention, after being replenished by ink flew through the ink passage, is to be increased, thus at the same time pushing the piston outwardly; the pressure is to be lowered again when ink is ejected through the ink nozzle, and the piston is again pushed inwardly to cause the ink passage to be connected again. The movement of the piston is not prominent but minute sliding, thus between the first and second ink chambers, the critical state of connection and near connection is to be maintained; with the attempted balance among the atmospheric pressure, resistance from the damping device and the negative pressure in the second ink chamber, the negative pressure in the second ink chamber for stable feeding of ink can be maintained.

BRIEF DESCRIPTION OF THE DRAWINGS

These and other features, aspects and advantages of the present invention will become better understood with regard to the following description, appended claims and accompanying drawings that are provided only for further elaboration without limiting or restricting the present invention, where:

FIG. 1 shows a diagram of the conventional ink cartridge (1);

FIG. 2 shows a diagram of the conventional ink cartridge (2);

DETAILED DESCRIPTION OF THE PREFERRED EMBODIMENT

Figure 3:
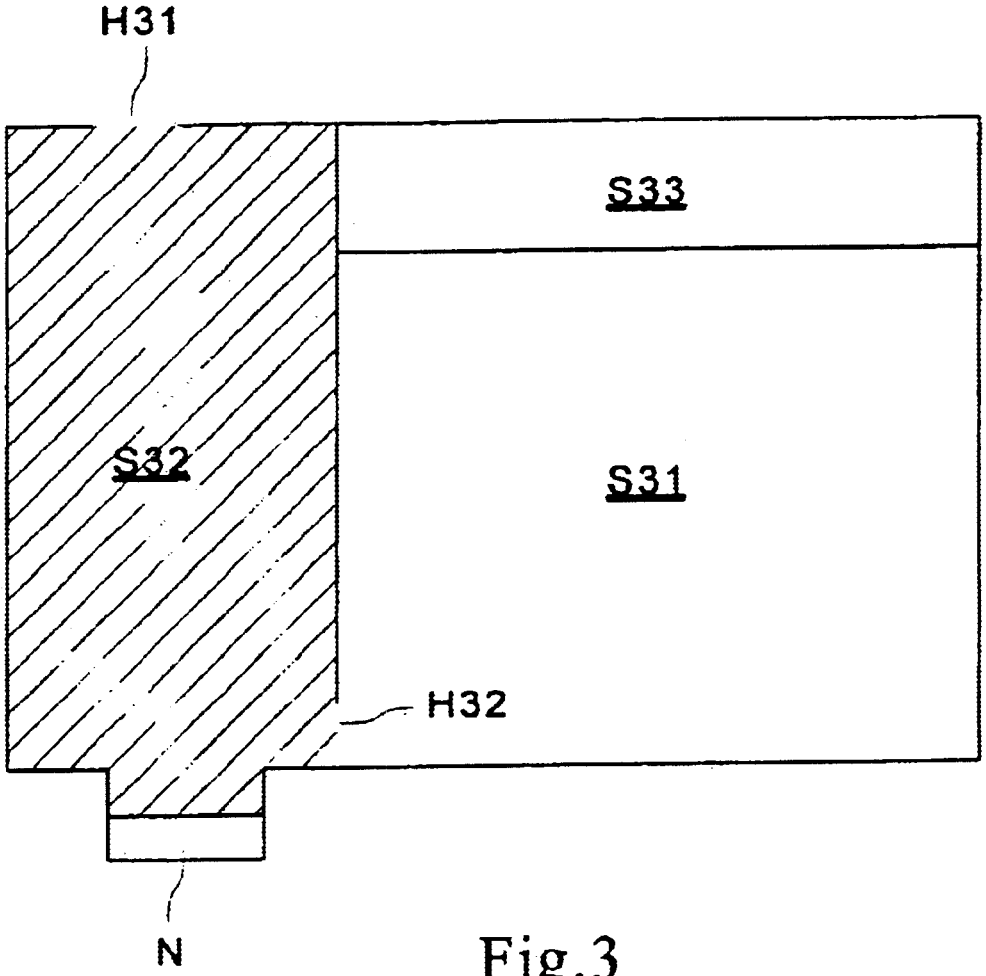
Fig.3 PRIOR ART
FIG. 3 shows a diagram of the conventional ink cartridge (3)
Figure 4:
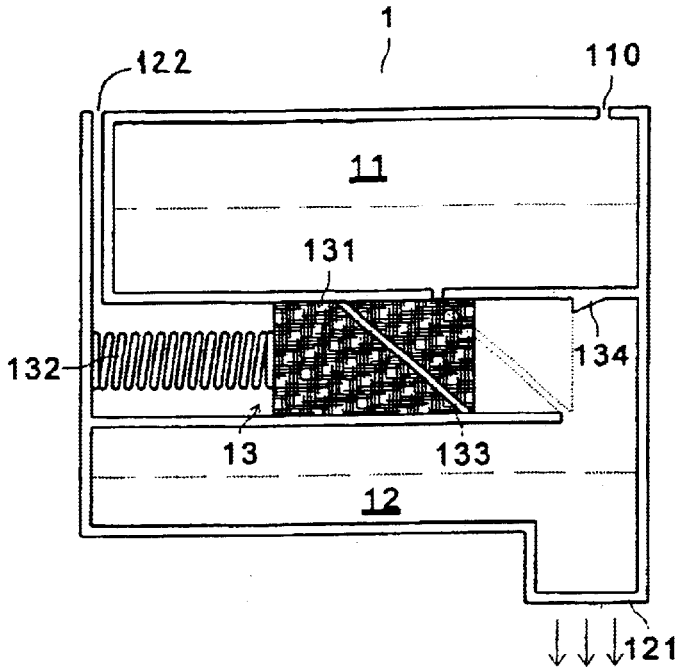
FIG. 4 shows a diagram of the first embodiment of the ink cartridge of the invention.

At first, please refer to FIG. 4, which shows a diagram of the ink cartridge 1 of the invention. The ink cartridge 1 comprises the first ink chamber 11, the second ink chamber 12 and the negative-pressure regulating mechanism 13; wherein on top of the first ink chamber an air vent 110 is installed, thus the pressure in the first ink chamber 11 can be maintained as 1 atm; an ink outlet 121 is installed on the lower side of the second ink chamber 12, so as to be used as both the ink-jet outlet for the ink cartridge 1, and the second ink chamber 12 has an air passage 122 that enables the ink cartridge to reach air outside. The regulating mechanism, installed at the passage of the second ink chamber 12, with one side thereof being an open space connected to the atmosphere, is used as a valve connecting the first and second ink chambers 11 and 12; when the ink cartridge is not open for use, the regulating mechanism 13 is under the state shown in FIG. 4.

The detailed structure is to be elaborated further. The regulating mechanism 13 is of a interlocking device comprising a piston 131 and a damping device 132; with the inner pressure in the second ink chamber 12 being lowered during the ink-feeding process, the piston 131 is to slidingly move inwards toward the second ink chamber 12. An ink passage 133 is installed in the piston 131, so that when the piston 131 slidingly moves inwards, the ink passage 133 is to connect the first and second ink chambers 11 and 12, and with the stopper 134 being the stopping device for the piston 131, the piston 131 is prevented from being too deep into the second ink chamber 12 so as not being able to connect the first and second ink chambers 11 and 12; therefore, during the ink-feeding process, ink in the first ink chamber 11 can flow through the ink passage 133 into the second ink chamber 12; at this time the piston 131 and the ink passage 133 are under the state shown in the dotted area of FIG. 4.

The second ink chamber 12 of the ink cartridge 1 of the invention is replenished with ink flowing through the ink passage 133, and the inner pressure thereof is to be increased, thus pushing the piston 131 outwards; at this time the ink passage 133 is closed, thus cutting off the feeding of ink from the first ink chamber 11. Later on, after the ink-feeding outlet 121 has spurted ink, the inner pressure of the second ink chamber 12 is to be lowered again, thus pushing the piston 131 inwards again, and the ink passage 133 is connected; also sliding movement for the piston 131 is not prominent but minute sliding, thus the interaction between the first and second ink chambers 11 and 12 under the critical state of connection and near connection is to be maintained; with the attempted balance among the atmospheric pressure, resistance from the damping device 132, friction force from the piston 131 and the negative pressure in the second ink chamber 12, the negative pressure in the second ink chamber 12 for stable feeding of ink can be maintained.

Please continue refer to FIG. 4, in the first embodiment of the invention, the damping device 132 is of a tension spring, with one end thereof being fixated to the inner wall of the ink cartridge 1, and the other end being fixated to the piston 131. When the piston 131 slidingly moves toward the second ink chamber 12, the tension spring is to be pulled and thus being extended and deformed, and thus it is to provide the piston 131 a pulling force through the elastic recoiling force thereof. Under the state of the second ink chamber 12 not ejecting ink, the gas volume in the second ink chamber 12, which is a closed space, is $V_1$, with the pressure therein being $P_1$; with the decrease of ink in the second ink chamber 12 the gas volume is to be enlarged into $V_2$, with the pressure decreased to $P_2$, thus conforming with Boyle's Law. Such relationship between gas volume and the pressure in the second ink chamber 12 is to be shown by the following equation:

$$P_1V_1=P_2V_2$$

Therefore, the pressure difference between the interior and exterior of the ink cartridge 1 is formed, thus causing the piston 131 to slide inwardly, and, with the ink passage 133 being used for connecting the first and second ink chambers 11 and 12, and the stopper 134 being the stopping device for the piston 131, ink from the first ink chamber 11 is to flow into the second ink chamber 12 through the ink passage 133, the state of the piston 131 and the ink passage 133 at this time is shown in the dotted area of FIG. 4. At this time the first and second ink chambers 11 and 12 are to interact under the state of connection and the critical state of connection, and with the attempted balance among the atmospheric pressure, the force from the tension spring, friction force from the piston 131 and the negative pressure in the second ink chamber 12, the negative pressure in the second ink chamber 12 for stable feeding of ink can be maintained.

Figure 5:
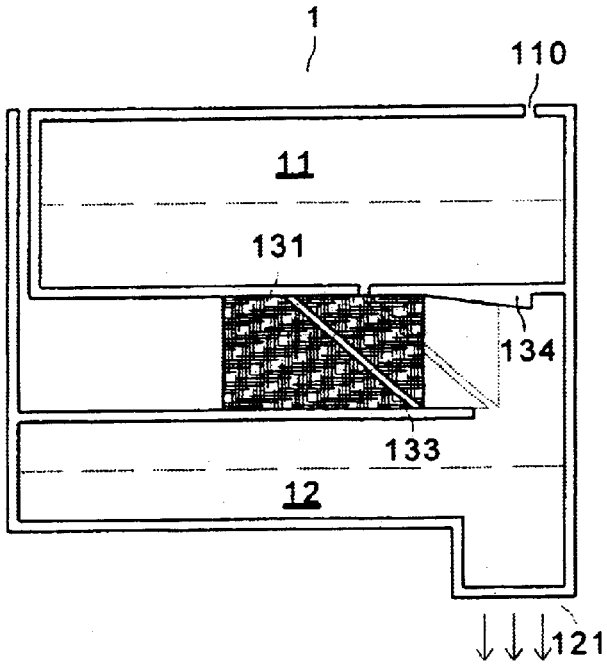
FIG. 5 shows a diagram of the second embodiment of the ink cartridge of the invention.

The second embodiment of the invention is shown in FIG. 5, wherein the regulating mechanism 13 is made of elastic material like rubber piston; the stopper 134 is of a non-slip block with biased surface, used for tapering the ink passage 133 of the second ink chamber 12. During the ink-feeding process from the second ink chamber 12, the pressure difference between the interior and exterior of the second ink chamber 12 is formed because of the decrease of the inner pressure, thus causing the elastic rubber piston to slide inwardly toward the second ink chamber 12; with the ink passage 133 being used for connecting the first and second ink chambers 11 and 12, ink from the first ink chamber 11 is to flow into the second ink chamber 12 through the ink passage 133, the state of the elastic rubber piston and the ink passage 133 at this time is shown in the dotted area of FIG. 5. At this time, with the elastic recoiling force, replacing the pulling force from the tension spring in the first embodiment, from the deformation of the elastic rubber piston while contacting the non-slip block, the first and second ink chambers 11 and 12 are to interact under the state of connection and the critical state of connection, and with the attempted balance among the atmospheric pressure, elastic recoiling force and friction force from the elastic rubber piston and the negative pressure in the second ink chamber 12, the negative pressure in the second ink chamber 12 for stable feeding of ink can be maintained.

Figure 6:
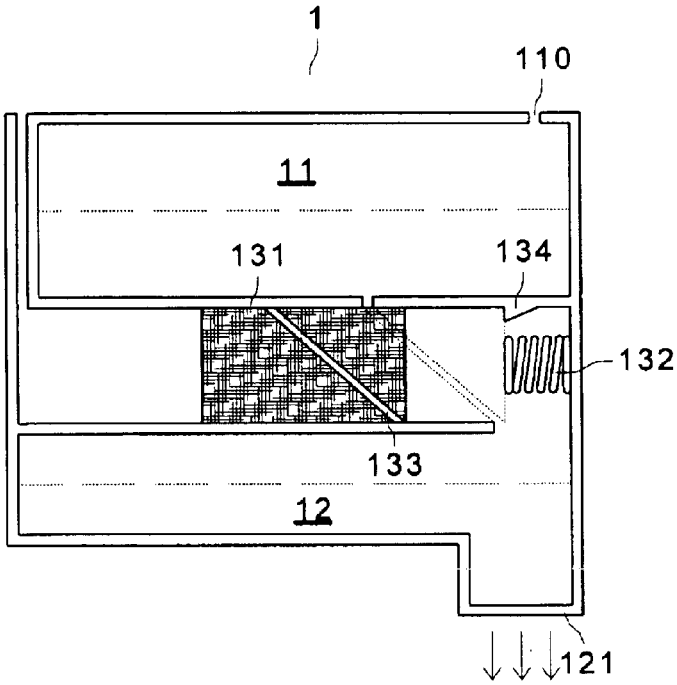
FIG. 6 shows a diagram of the third embodiment of the ink cartridge of the invention.

The third embodiment of the invention is shown in FIG. 6 , wherein the tension spring is further replaced with the thrust spring; as the piston 131 slides forward toward the second ink chamber 12, the thrust spring is to bear pressure and thus compressed and deformed, with the elastic recoiling force providing the piston 131 a pushing force. During the ink-feeding process of the ink cartridge 1, the first and second ink chambers 11 and 12 are to interact under the state of connection and the critical state of connection, and with the attempted balance among the atmospheric pressure, the pushing force of the thrust spring, the friction force of the piston 131 and the negative pressure in the second ink chamber 12, the negative pressure in the second ink chamber 12 for stable feeding of ink can be maintained.

Figure 7:
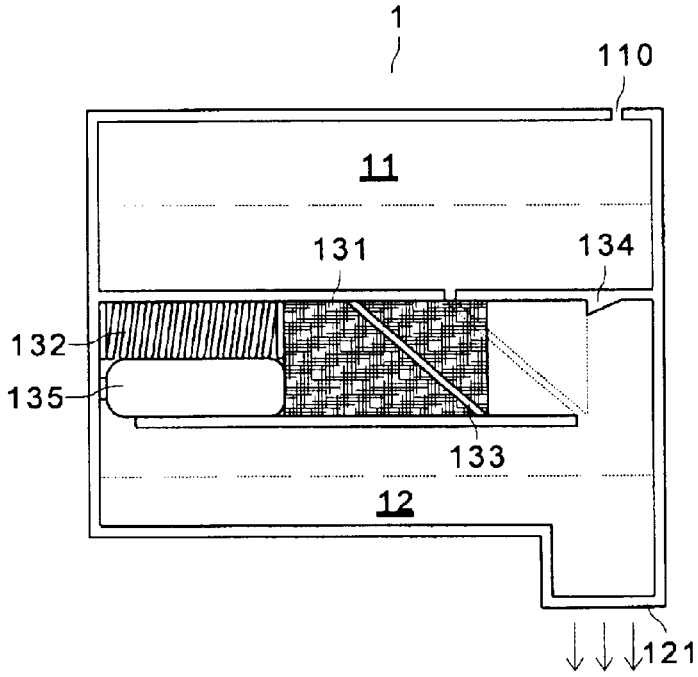
FIG. 7 shows a diagram of the fourth embodiment of the ink cartridge of the invention.

The fourth embodiment of the invention is shown in FIG. 7, wherein the damping device 132 further forms with a tension spring and a fixated and sealed air bladder 135 that are installed in the second ink chamber 12. The fourth embodiment of the invention is to close the open space on the side of the regulating mechanism 13 in the first embodiment of the invention shown in FIG. 4, and further replace the atmospheric pressure with pressure in the air bladder 135. Under the state of the second ink chamber's not ejecting ink, the gas volume in the second ink chamber 12, which is a closed space, is $V_3$, with the pressure therein being $P_3$; with the decrease of ink in the second ink chamber 12 the gas volume is to be enlarged into $V_4$, with the pressure decreased to $P_4$, thus conforming with Boyle's Law. Such relationship between gas volume and the pressure in the second ink chamber 12 is to be shown by the following equation:

$$P_3V_3=P_4V_4$$

Therefore, during the ink-feeding process of the ink cartridge 1, because the enlargement of the air bladder 135 increases the enlargement force and thus further pushes the piston 131 to displace, the pulling force of the tension spring is to be increased; also since the inner pressure of the second ink chamber 12 is to be increased by the replenishment of ink from the first ink chamber 11, thus enabling the first and second ink chambers 11 and 12 to interact under the state of connection and the critical state of connection, and with the attempted balance among the inflation force of the air bladder 135, the pulling force of the tension spring, the friction force of the piston 131 and the negative pressure in the second ink chamber 12, the negative pressure in the second ink chamber 12 for stable feeding of ink can be maintained.

Figure 8:
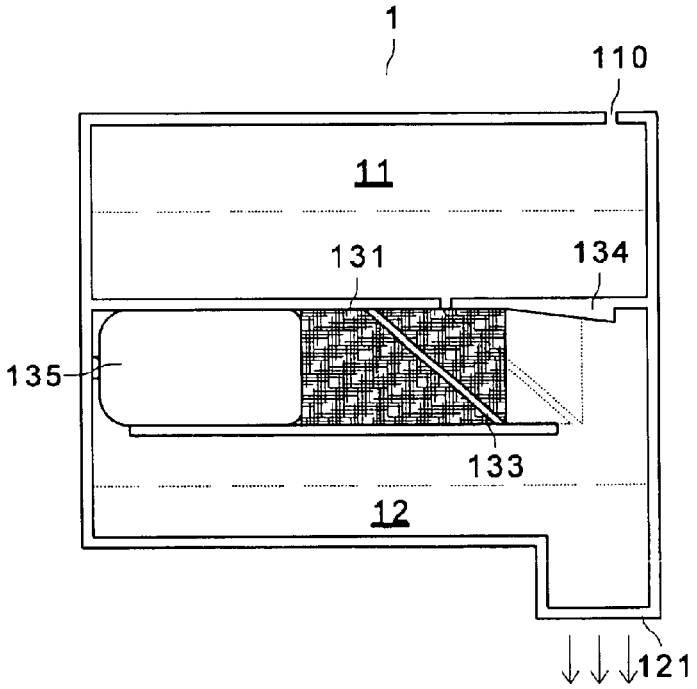
FIG. 8 shows a diagram of the fifth embodiment of the ink cartridge of the invention.

The fifth embodiment of the invention is shown in FIG. 8, wherein the fifth embodiment of the invention is to close the open space on the side of the regulating mechanism 13 in the second embodiment of the invention shown in FIG. 5, and connect such space to the second ink chamber 12, and further replace the atmospheric pressure with pressure in the air bladder 135. During the ink-feeding process of the ink cartridge 1, the first and second ink chambers 11 and 12 are to interact under the state of connection and the critical state of connection, and with the attempted balance among the inflation force of the air bladder 135, elastic recoiling force and the friction force of the elastic rubber piston, and the negative pressure in the second ink chamber 12, the negative pressure in the second ink chamber 12 for stable feeding of ink can be maintained.

Figure 9:
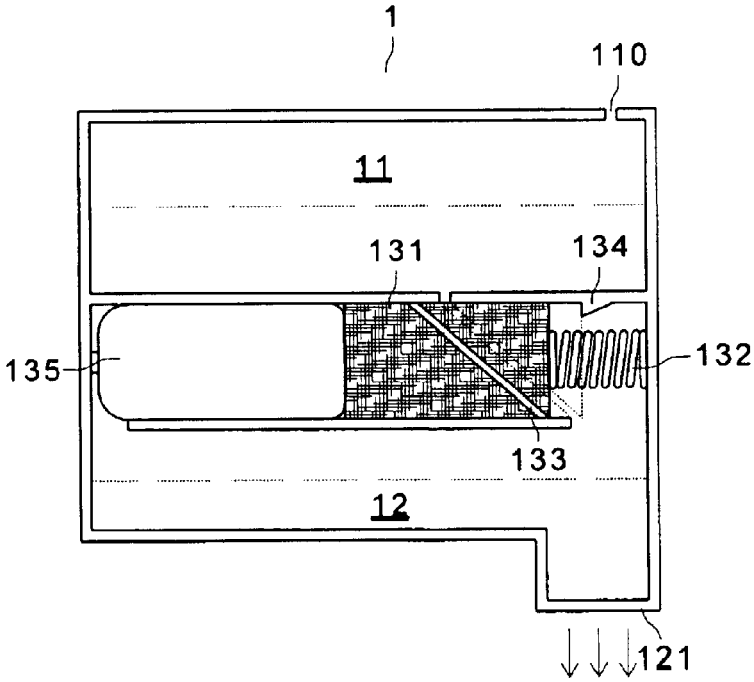
FIG. 9 shows a diagram of the sixth embodiment of the ink cartridge of the invention.

The sixth embodiment of the invention is shown in FIG. 9, wherein the sixth embodiment of the invention is to close the open space on the side of the regulating mechanism 13 in the third embodiment of the invention shown in FIG. 6, and connect such space to the second ink chamber 12, and further replace the atmospheric pressure with pressure in the air bladder 135. During the ink-feeding process of the ink cartridge 1, the first and second ink chambers 11 and 12 are to interact under the state of connection and the critical state of connection, and with the attempted balance among the inflation force of the air bladder 135, the pushing force of the thrust spring, the friction force of the piston 131 and the negative pressure in the second ink chamber 12, the negative pressure in the second ink chamber 12 for stable feeding of ink can be maintained.

Figure 10:
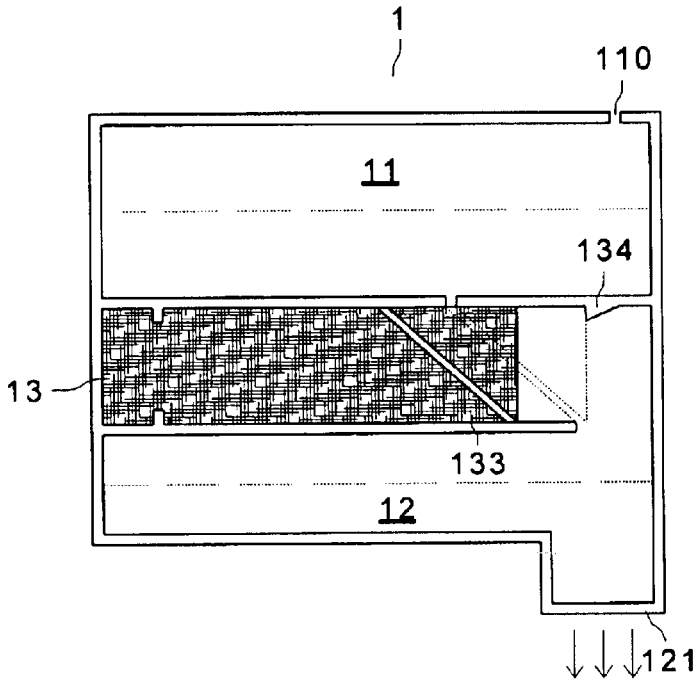
FIG. 10 shows a diagram of the seventh embodiment of the ink cartridge of the invention.

The seventh embodiment of the invention is shown in FIG. 10, wherein the regulating mechanism 13 is of an elastic rubber piston, with one end thereof fixated to be the fixating end, and the other end being the free end capable of being freely stretched. Before the ink cartridge 1 is yet to be opened for use, the elastic rubber piston is to be under the state shown by the solid line in FIG. 10. With the lowering of the inner pressure in the second ink chamber 12 during the ink-feeding process, the free end of the elastic rubber piston is to be pulled and thus extended toward the inside of the second ink chamber 12; an ink passage 133 is installed on the elastic rubber piston, thus as the piston slides inwardly, the ink passage 133 is used for connecting the first and second ink chambers 11 and 12, and with the stopping block 134 being the stopping device for the piston, ink in the first ink chamber 1 is to flow through the ink passage 133 into the second ink chamber 12; at this time the piston and the ink passage 133 are in the position shown in the dotted area of FIG. 10.

Figure 11:
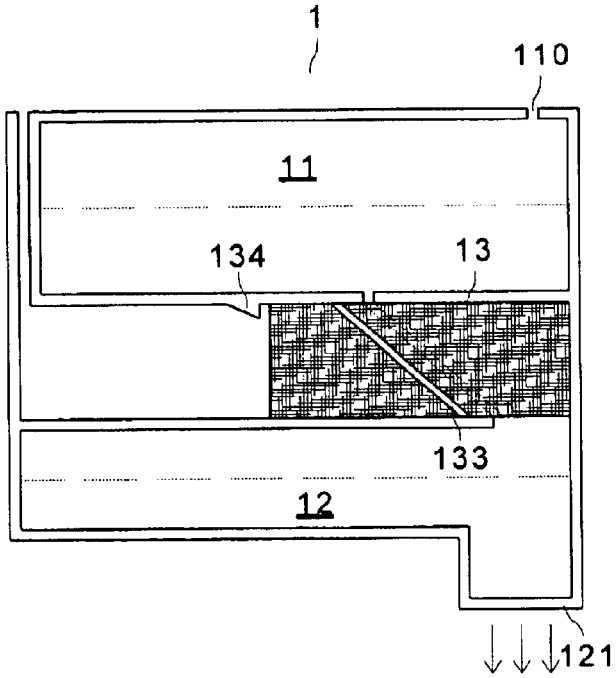
FIG. 11 shows a diagram of the eighth embodiment of the ink cartridge of the invention.

The eighth embodiment of the invention is shown in FIG. 11, wherein the regulating mechanism 13 is of an elastic rubber piston, with the right end thereof fixated to be the fixating end, and the left end being the free end capable of being compressed. Before the ink cartridge 1 is yet to be opened for use, the elastic rubber piston is to be under the state shown by the solid line in FIG. 11. With the lowering of the inner pressure in the second ink chamber 12 during the ink-feeding process, the pressure on two sides of the piston is not to be equivalent, thus causing the pressure on the left side of the elastic rubber piston to be larger, therefore the compression and deformation are caused toward the right side thereof, and the piston is to withdraw inwardly toward the second ink chamber 12; an ink passage 133 is installed on the elastic rubber piston, thus as the piston withdraws toward the right, the ink passage 133 is used for connecting the first and second ink chambers 11 and 12, and ink in the first ink chamber 1 is to flow through the ink passage 133 into the second ink chamber 12; at this time the piston and the ink passage 133 are in the position shown in the dotted area of FIG. 11. During the process of replenishing ink into the second ink chamber 12, the inner pressure is to increase, thus providing the piston with an elastic recoiling force, and enabling the piston to return back to the initial state shown by the solid line of FIG. 11, or resume to the similar state and stop the ink-feeding process.

In the seventh and eighth embodiment of the invention, the preferred embodiment for the material of the piston should be PU foam. Also in the eighth embodiment of the invention, the right side of the PU foam is not limited to be a fixated end, and it can further be installed with a stopping block 134, thus causing the distance between the stopping block 134 and the right side wall of the ink cartridge 1 to be identical to the length of the PU foam not enduring a outside force. With the lowering of the inner pressure in the second ink chamber 12 during the ink-feeding process, thus causing the pressure on the left side of the elastic rubber piston to be larger, the compression and deformation are caused toward the right side thereof, and the piston is to withdraw inwardly toward the second ink chamber 12; an ink passage 133 is installed on the elastic rubber piston, thus as the piston withdraws toward the right, the ink passage 133 is used for connecting the first and second ink chambers 11 and 12. During the process of the ink replenishment of the second ink chamber 12, a recoiling force from the PU foam is provided, so as to cause the PU foam to inflate toward the left and resume, and with the stop of the stopping block 134, the PU foam is prevented from further inflation toward the left side or displaced.

Figure 12:
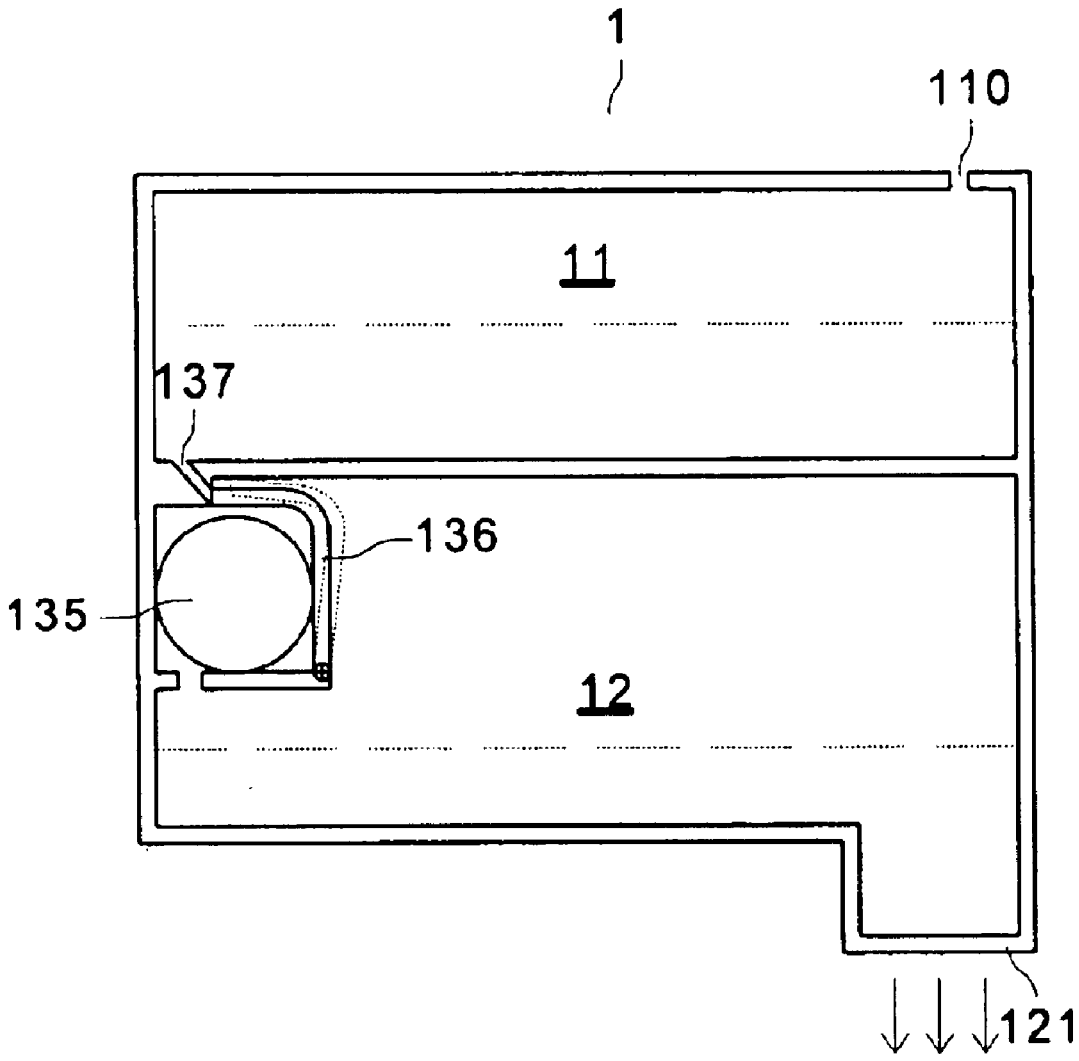
FIG. 12 shows a diagram of the ninth embodiment of the ink cartridge of the invention.

The ninth embodiment of the invention is shown in FIG. 12, wherein an ink passage 137 is installed between the first and second ink chambers 11 and 12; the regulating mechanism 13 is installed on the second ink chamber 12, including an aid bladder 135 and an L-shaped linking lever 136; on the one end of the L-shaped linking lever a pivot is fixated, with the other end being a free end capable of being rotated freely, and the air bladder 135 is installed inside the area surrounded by the linking lever 136. As the ink cartridge 1 is not yet opened for use, the air bladder 135 and the L-shaped linking lever 136 are under the state shown by the solid line in FIG. 11, and at the same time the ink passage 137 is closed. With the lowering of the inner pressure of the second ink chamber 12 during the ink-feeding process, the air bladder 135 is to be inflated, and further causes the linking lever 136 to rotate by the pivot portion, and then the ink passage 137 is to be opened. By the ink passage 137 connecting the first and second ink chambers 11 and 12, ink in the first ink chamber 11 is to flow through the ink passage 137 into the second ink chamber 12; at this time the air bladder 135 and the linking lever 136 are in the position shown in the dotted area of FIG. 11. As the second ink chamber 12 is replenished with proper amount of ink, the inner pressure in the second ink chamber 12 is to increase, thus compressing the volume of the air bladder 135, and causing the linking lever 136 to resume back to the initial state.

Although the present invention has been described in considerable detail with reference to certain preferred embodiments thereof, those skilled in the art can easily understand that all kinds of alterations and changes can be made within the spirit and scope of the appended claims. Therefore, the spirit and scope of the appended claims should not be limited to the description of the preferred embodiments contained herein.

What is claimed is:

1. An ink cartridge, having a first ink chamber and a second ink chamber, said first ink chamber having an air vent to reach air outside, and said second ink chamber is inter-connected to said first ink chamber and formed with an air passage to reach air outside; with the working of an regulating mechanism in said air passage, the negative pressure in said second ink chamber of said ink cartridge can be regulated; said regulating mechanism comprising:

a piston, installed in said air passage, used for opening or closing the interconnection between said first and second ink chambers;

a damping device, installed in said air passage, used for providing a damping force to said piston;

wherein, the pressure of said air outside, said damping force and said negative pressure co-act on said piston, causing said piston to displace in said air passage for the opening and closing of the interconnection between said two ink chambers, thus adjusting the negative pressure in said second ink chamber;

said piston has an ink passage that enables ink in said first ink chamber to flow into said second ink chamber through said ink passage;

said damping device comprises a spring;

said spring comprises a tension spring, with the two ends thereof being respectively fixated on said piston and the inner wall of said ink cartridge; said damping force acting on said piston comprises a pulling force; and a stopping block is installed on the inner wall of said air passage, causing said piston to be stopped by said stopping block during displacement in said air passage, thus enabling ink in said first ink chamber to flow into said second ink chamber through said ink passage.

* * * * *